US005852945A

United States Patent [19]

Burger

[11] Patent Number: 5,852,945

[45] Date of Patent: Dec. 29, 1998

[54] APPARATUS FOR FORMING ROD-LIKE COMPONENTS

[76] Inventor: Georg Burger, Obere Wank, D-87484 Nesselwang, Germany

[21] Appl. No.: 899,221

[22] Filed: Jul. 23, 1997

[30] Foreign Application Priority Data

Jul. 25, 1996 [DE] Germany ..... 196 30 023.1

[51] Int. Cl.[6] ..... B21D 7/022

[52] U.S. Cl. ..... 72/306; 72/311

[58] Field of Search ..... 72/306, 307, 311, 72/298, 217, 149, 159, 404

[56] References Cited

U.S. PATENT DOCUMENTS

| | | | |
|---|---|---|---|
| 3,916,665 | 11/1975 | Hancock | 72/306 |
| 4,681,210 | 7/1987 | Miki | 72/307 |
| 4,735,075 | 4/1988 | Saegusa | 72/306 |
| 5,284,041 | 2/1994 | Christensen | 72/159 |

FOREIGN PATENT DOCUMENTS

| | | | |
|---|---|---|---|
| 1087431 | 8/1960 | Germany | 72/149 |
| 2353028 | 6/1974 | Germany | 72/306 |
| 60-169119 | 7/1985 | Japan | 72/217 |
| 1207562 | 1/1986 | U.S.S.R. | 72/217 |

*Primary Examiner*—Daniel C. Crane
*Attorney, Agent, or Firm*—Collard & Roe, P.C.

[57] ABSTRACT

Apparatus for forming and in particular for bending rod-like components or sections of pipe with clamping units that can rotate and can travel longitudinally within the machine and transversely with the machine as well as with at least two bending units that are located in separate processing stations which are located on different sides of the clamping units and can rotate.

16 Claims, 5 Drawing Sheets

15/16

APPARATUS FOR FORMING ROD-LIKE COMPONENTS

BACKGROUND OF THE INVENTION

1. Field of the Invention

The present invention relates to an apparatus for forming components, and in particular for bending rod-like components. The apparatus includes clamping units that can rotate and can move longitudinally within the machine and can move in the transverse direction as well. Also, there are at least two bending units that are located in separate processing stations.

2. The Prior Art

An apparatus of this kind has been disclosed in DE 4,300,311 C2. This apparatus is very effective in practical operation, but cannot be used efficiently to produce a very large number of bends in a single component.

SUMMARY OF THE INVENTION

It is an object of the present invention to provide an apparatus for forming rod-like components in such a way that it can be used efficiently to form complexly shaped components.

The present invention is directed to an apparatus for forming and for bending rod-shaped components and sections of pipe comprising clamping units that are rotatable and are positioned to move longitudinally along a length of the apparatus and to move transversely along a width of the apparatus; and at least two bending units that are located in separate processing stations on different sides of the clamping units and said bending units are rotatable.

The above object is achieved by the present invention because the bending units are located on different sides of the clamping unit and can rotate.

Thus, a wide range of different bends can be produced and this is possible even at both ends of the component at the same time. This is possible without turning the component around. Also the rotating function of the bending unit makes it possible to carry out the bending operation very exactly and efficiently.

In another embodiment of the invention, the clamping unit has two clamping jaws, each of which is pivoted on one side. There is also an adjustment unit which engages each of these two clamping jaws and adjusts the position of the clamping jaws in relation to each other. This makes it possible for the clamping jaws to move apart, and for the component to be loaded between them. Then the clamping jaws can grasp the component securely when they move back together again. As a result of this, it can be assured that the components are grasped very quickly and are clamped securely during the transport thereof.

In a further embodiment of the invention, each of the two clamping jaws is provided with gear teeth arranged in the shape of a circular arc that mesh with each other. This makes certain that the clamping jaws move synchronously and always clamp the component centrally.

In another embodiment of the invention the adjustment units engage each of the two clamping jaws in a location facing away from the pivot bearing. Each adjustment unit comprises an adjustment wedge connected to an adjustment cylinder. A very simple and reliable actuating mechanism is created in this way, while the clamping unit is capable of exerting a sufficiently high level of clamping force.

In a further embodiment of the invention, the adjustment wedge is given support by an additional bearing that is preferably designed to be pivoted. This means that the adjustment cylinder does not have to absorb any transverse force.

In another embodiment of the invention, the clamping jaws have clamping inserts, each of which is provided with an opening in the form of a circular segment. There are two circular segments which together are shaped to match the external diameter of the components that are to be processed. The clamping inserts are supported in the clamping jaws in such a way that they can be changed. These separate clamping inserts make it simple to adapt the clamping unit to different size components.

In a further embodiment of the invention, the clamping unit is pivoted around a horizontal axis of rotation to permit swivel movement. This makes it easy to position the component at the required angle.

In another embodiment of the invention, the clamping unit has an at least approximately circular housing that is provided with a radially located opening. This radial opening projects beyond the central point of the housing at one end of the opening and is open towards the outside of the housing at the other end of the radial opening. This opening makes it possible to insert a component in the radial direction and to release it again in the radial direction, which considerable facilitates the handling of the component.

In a further embodiment of the invention, a drive belt engages the external circumference of the clamping unit and surrounds the clamping unit to a very large extent. Thus, it is easy to precisely swivel the clamping unit by using this drive belt connected to a drive motor.

In accordance with another embodiment of the invention, each one of the two ends of the drive belt is attached to an edge of the radial opening. This has the effect on the one hand that the drive motor is surrounded by the drive belt in an endless arrangement. On the other hand, the drive belt does not obstruct the loading and releasing of a component by the clamping unit.

In a further embodiment of the invention, the bending units are comprised of two parts, with an essentially cylindrical bottom section and a top section that is adapted to match the bottom section. There is a semi-circular groove that has the same diameter as the diameter of the component which is to be bent. This groove is open towards the outside and is incorporated into both of these sections at the point where the bottom section meets the top section.

The clamping unit places the component in this groove in the bending unit, which then bends the component by the turning of the bending unit to a larger or smaller extent. It has proved to be very advantageous in this context if the groove extends at least 180° around the circumference. The result is that bends can be made to this extent.

In another embodiment of the invention, a groove section that is completely enclosed, extends tangentially and is open at its two external ends. This enclosed groove section is adjacent to the groove that is open towards the outside. The component is placed in this enclosed groove section, and projects out of the groove section on both sides. The component is held by the enclosed section and can be bent by turning the bending unit while it is secured in this position.

In a further embodiment of the invention, the top section of the bending unit is constructed to permit axial movement in relation to the bottom section of the bending unit. In order to load the component into the bending unit, the top section is raised. The result is that the component can be placed in the groove by the clamping unit without it being necessary for the component to move axially.

In another embodiment of the invention, the bottom section of the bending unit is constructed to permit axial movement. As a result of this, the bottom section can be lowered or raised to such an extent that the component can be placed horizontally into the open groove in the bending unit.

In a further embodiment of the invention, a guide unit for securing the components in position in the radial direction is provided directly before the bending unit (seen from the direction of the clamping unit). The open cross-section of this guide unit is slightly larger than the external cross-section of the component. The guide unit can be opened so that the component can be loaded from the side.

Due to this guide unit, the clamping unit can be removed from the component after the component has been grasped by the guide unit and the bending unit. The clamping unit can then return to collect the next component that is arriving from the previous processing station.

In another embodiment of the invention, the bottom section and the top section are supported in the bending unit in such a way that they can be taken out. This makes it easy to adapt the actual bending tool to the component and bending radius involved in each individual case.

BRIEF DESCRIPTION OF THE DRAWINGS

Other objects and features of the present invention will become apparent from the following detailed description considered in connection with the accompanying drawing which discloses several embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
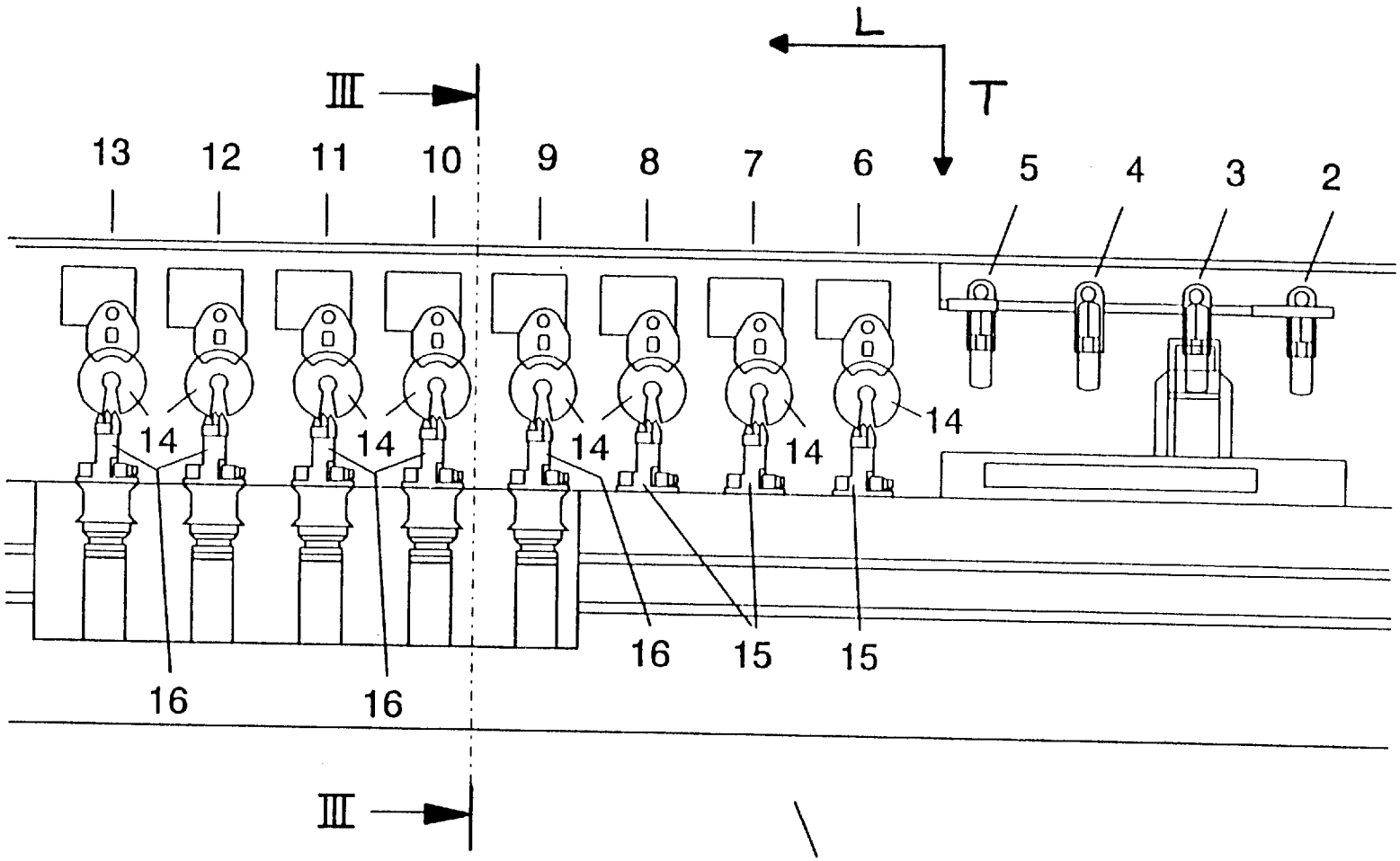
FIG. 1 shows a diagrammatic side view of an apparatus with clamping units and bending units for forming rod-like components in a number of processing stations.

Turning now in detail to the drawings, FIG. 1 shows an apparatus 1 that is equipped with four preparatory stations 2 to 5 and eight bending stations 6 to 13. Rod-like components such as sections of pipe, that are not illustrated in FIG. 1, are given preliminary treatment in the stations 2 to 5 of this apparatus 1. Connection nuts can, for example, be applied here and the ends of the pipes can be flanged. A clamping unit 14 and a bending unit 15 or 16 is provided in each of the bending stations 6 to 13.

Figure 2:
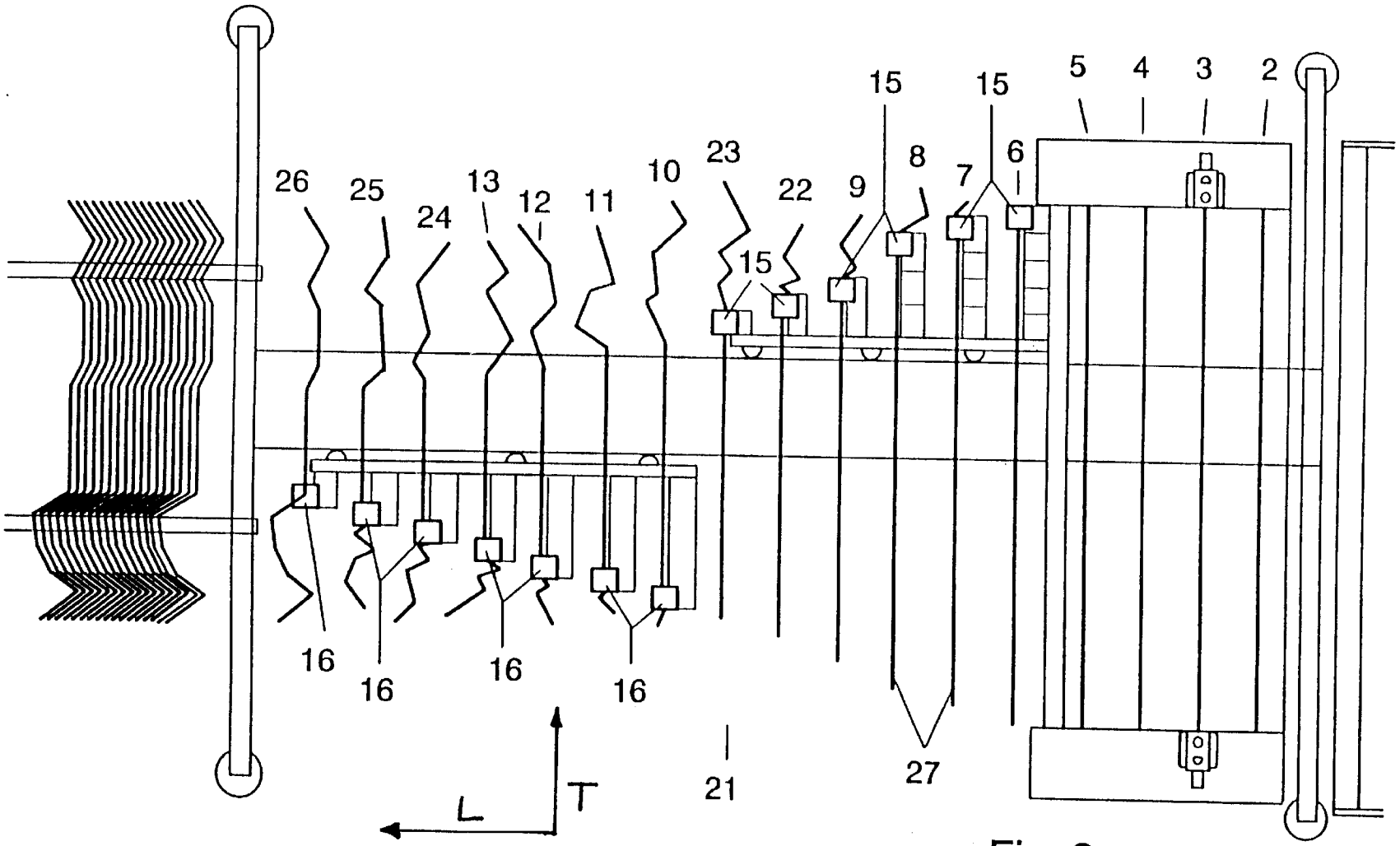
FIG. 2 shows a top diagrammatic view of the apparatus of FIG. 1, with more processing stations than are shown in FIG. 1 and with components also being illustrated.

Four preparatory stations 2 to 5 are also provided in the apparatus 21 illustrated in FIG. 2 as well as thirteen bending stations 6 to 13 and 22 to 26. The clamping units have been left out here to make it easier to see the bending stations. Each of the individual processing stations is allocated one section of pipe 27. Pipe section 27 is in a straight, rod-like state in the preparatory stations 2 to 5, where it is treated at both of its ends as has been outlined above. A large number of individual bending operations is carried out in the bending stations, first on one side and then on the other side. The bending operations start in each case from the end of the pipe, with the section of pipe being turned between each of these bending operations. It is also conceivable to carry out bending operations on both sides of the section of pipe 27 at the same time if they are required to be in the same plane.

Figure 3:
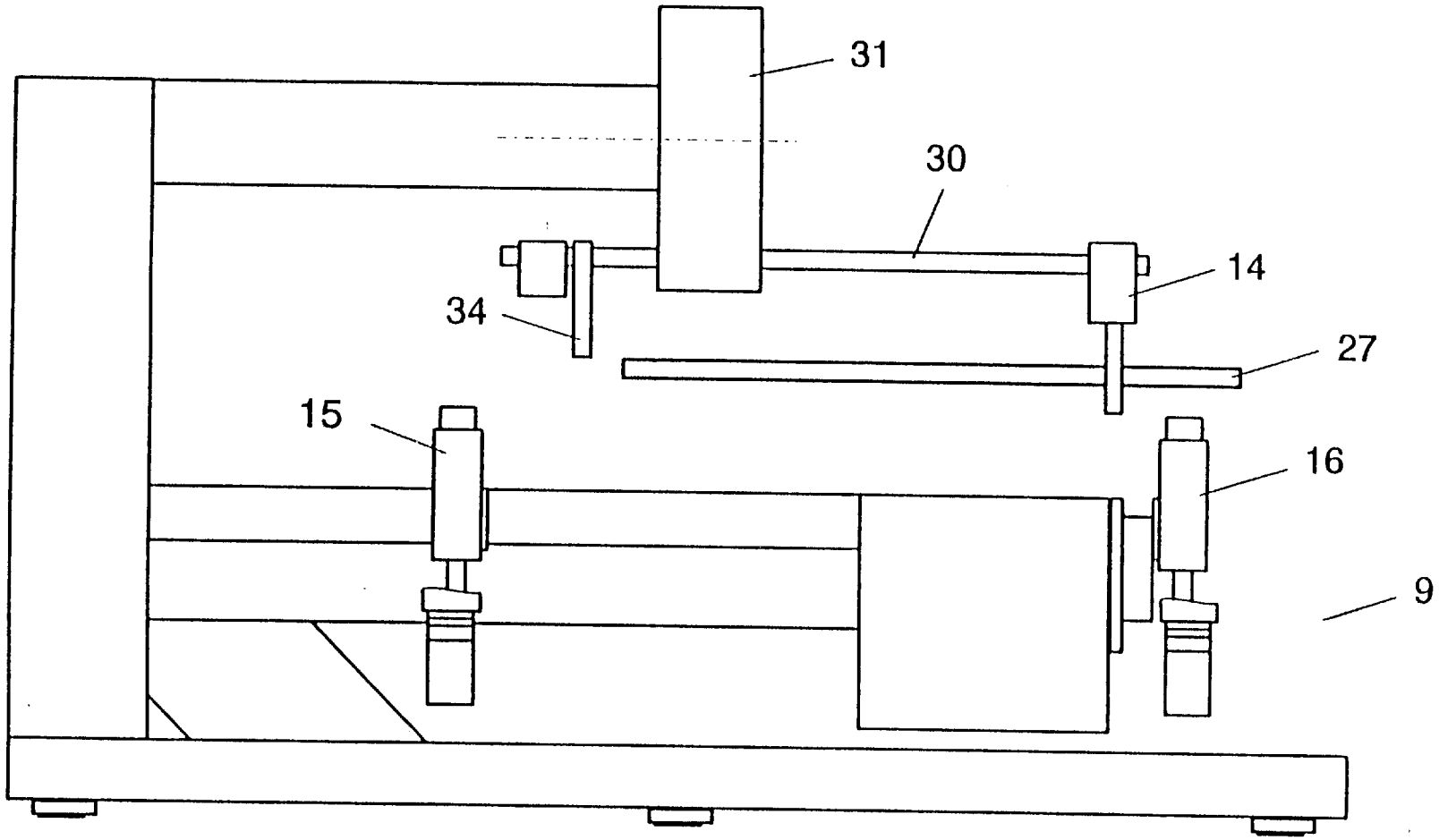
FIG. 3 is a cross-section through the apparatus along the line III—III in FIG. 1.

The cross-section that is illustrated in FIG. 3 shows a back bending unit 15, a front bending unit 16 and a clamping unit 14. A support 34 is also provided, which is used in particular with long components in order to hold the back end in position and to make sure it does not vibrate. The clamping unit 14 is holding a section of pipe 27, while the two bending units 15 and 16 and the support 34 have been moved back to their respective home positions. The bending station on the right is bending station 9 as shown in FIG. 1. The bending unit 16 is raised from the position it is shown in here, after which the section of pipe 27 is inserted in it and is clamped securely by the bending unit as well as by a guide unit that is not shown in the drawing. The clamping unit 14 is then released from the component 27, after which the required bend is produced by turning the bending unit. The next clamping unit then engages the section of pipe 27. Then the bending unit 16 releases the section of pipe again so that the clamping unit 14 can pass the section of pipe on to the next bending unit in station 10.

To make this possible, the clamping units 14 are attached to shafts 30 which are in turn supported in a drive unit 31 in order to permit movement in both the longitudinal machine direction L and the transverse machine direction T. Direction T is perpendicular to direction L, as shown in FIGS. 1 and 2. Direction L is along the length of the apparatus and direction T is across the width of the apparatus. The bending unit 15 that is shown in FIG. 3 is located so that it can move at right angles to the longitudinal direction of the machine in order to enable very long sections of pipe to be bent.

Figure 4:
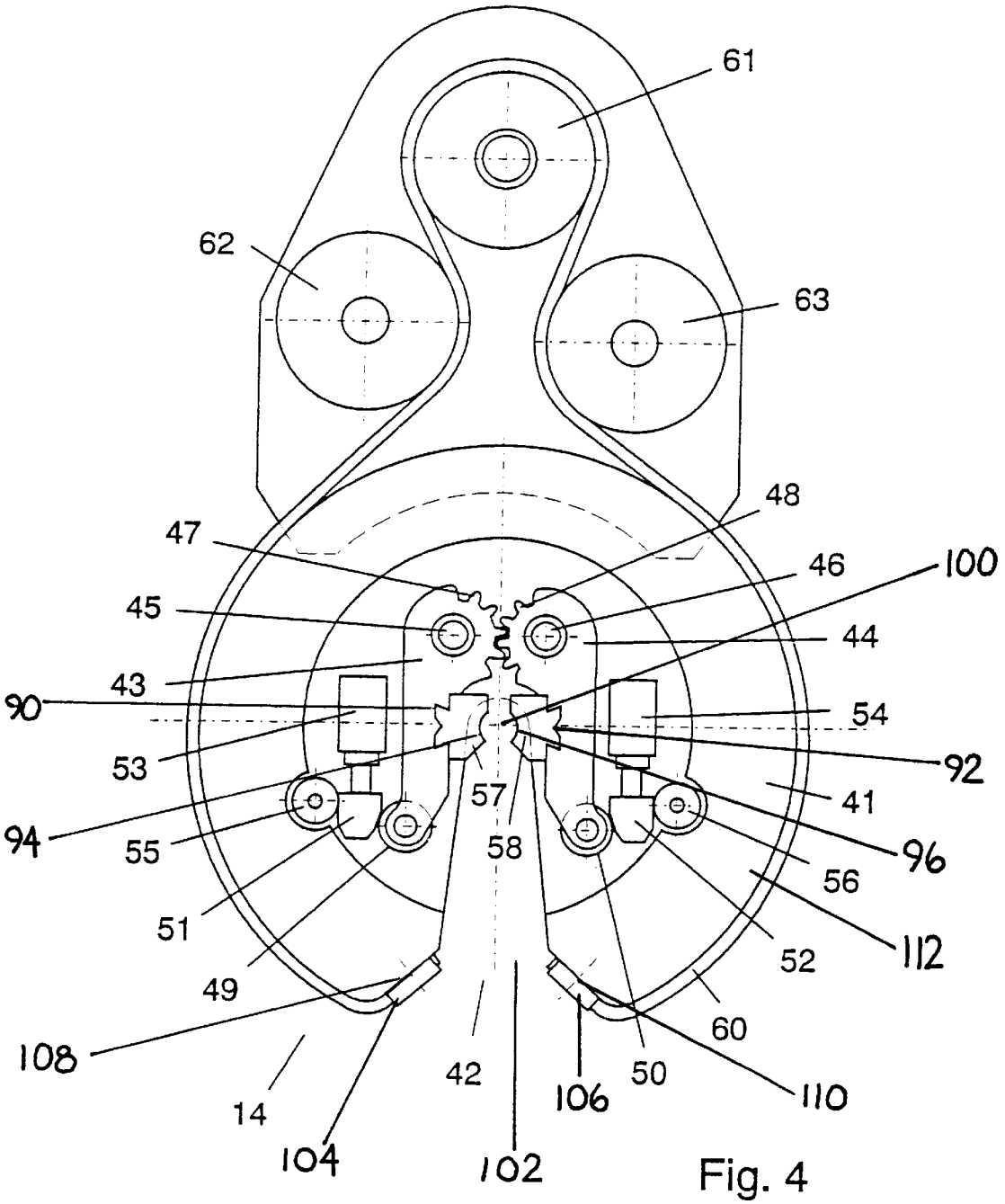
FIG. 4 shows a clamping unit.

A clamping unit 14 with a circular housing 41 is shown in FIG. 4 in greater detail. This housing has a slit-like radial opening 42 that extends from the outside end 102 and edge inwardly and somewhat further therein than the middle or central point 100 of the housing. Two clamping jaws 43 and 44 are pivoted on the housing 41 to permit swivel movement. Jaws 43 and 44 are provided with gear teeth 47, 48, respectively located concentrically around their swivel bearings 45, 46, respectively that mesh with each other. A pivoted sleeve 49, 50 is engaged by an adjustment unit comprising an adjustment wedge 51, 52, respectively that is actuated by an adjustment cylinder 53, 54, respectively. This is given additional support by a pivot bearing 55, 56, respectively and is provided at the opposite end of each of the two clamping jaws from the swivel bearings 45, 46. Clamping inserts 57, 58, respectively are secured in both clamping jaws 43, 44 with dovetail guides 90 and 92 that are provided with an opening in the shape of a circular segment 94 and 96 which the section of pipe 27 can engage. The dovetail guides make the clamping inserts simple to change, so that they are easy to adapt to the sections of pipe 27 that have to be processed in each particular case. The housing 41 is pivoted around the central point 100 of the openings in the clamping inserts 57, 58 in a way that is not illustrated here.

A drive belt 60 has two free ends 104 and 106 which are attached to the housing at locations 108 and 110 in the area of the outside end 102 of the opening 42. The drive belt 60 rests against the outside 112 of the housing. The drive belt 60 is looped around a drive wheel 61, with two guide and tensioning wheels 62 and 63 being located between the drive wheel 61 and the housing 41. The position of the tensioning wheel 63 can be changed in relation to the drive belt so that the tension level can be adjusted. The effect of the two guide and tensioning wheels is to make sure that both the drive wheel 61 and the housing 41 are surrounded by the drive belt 60 to a very large extent, which is from 65% to 90%.

Figure 5:
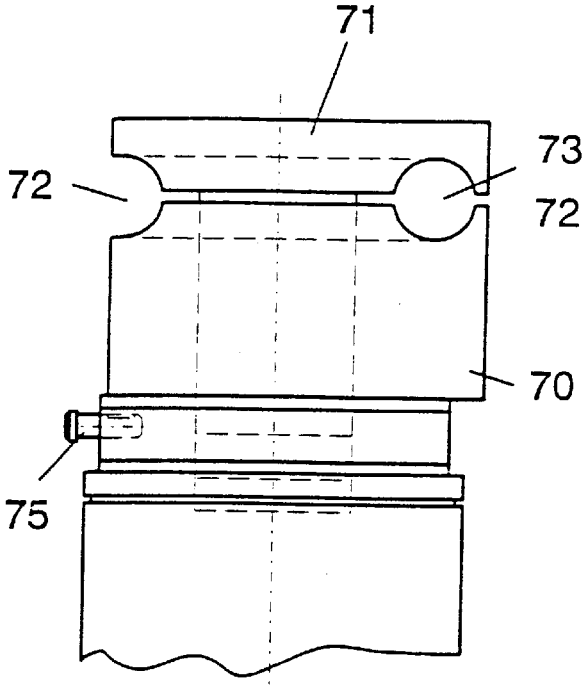
FIG. 5 shows a side view of a bending unit.
Figure 6:
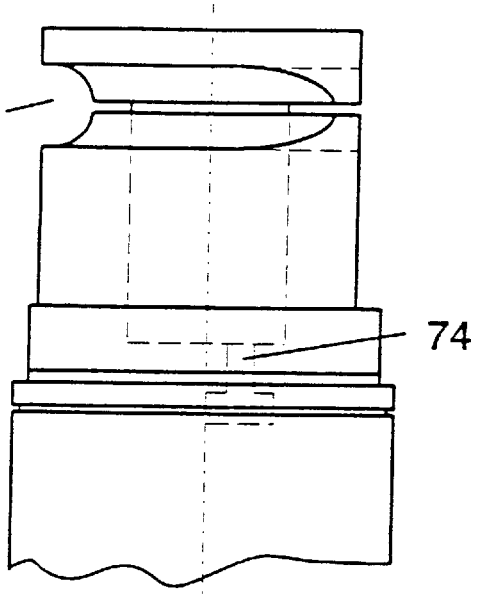
FIG. 6 shows another side view of the bending unit illustrated in FIG. 5.
Figure 7:
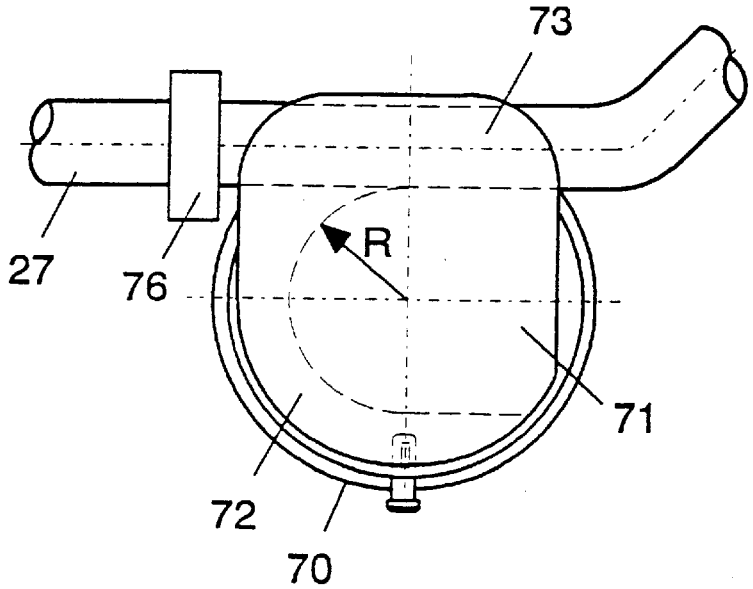
FIG. 7 shows a top view of the bending unit illustrated in FIGS. 5 and 6.

FIGS. 5 to 7 show in greater detail one of the bending units 15/16 that are illustrated in FIGS. 1 to 3. This bending unit comprises a bottom section 70 and a top section 71 that are connected to each other so that they move together. A semi-circular first groove 72 that is open towards the outside is incorporated in the bottom section and in the top section, with half of this groove being located in each of the two sections. The groove extends through about 180° of the circumference. A second groove section 73 that is completely enclosed extends tangentially between the top section and the bottom section starting from the groove 72. Section 73 is adjacent to this groove 72.

As is indicated in FIG. 7, the part of the section of pipe 27 that is facing away from a guide unit 76 is inserted in this tangential groove section 73. When the bending unit is turned, the section of pipe is then bent in accordance with the radius R and the angle of rotation. The top section 71 is raised in order to take hold of or to remove the section of pipe 27, so that the section of pipe 27 can be placed in and taken out of the groove section 73 from the side. The guide unit 76 is opened at the same time during the insertion and removal of the pipe section, so that smooth lateral insertion and removal is guaranteed here as well. When the top section and the bottom section have been moved back together again and the guide unit has been closed, the whole of the bending unit is lowered. Thus the subsequent bending operation itself can be completed without any obstruction by the clamping units.

The top section and bottom section are held in the bending unit by a T-shaped projection. When the bottom section 70 has been raised and the top section 71 is open, an unlocking button 75 that is located on the outside of the bending unit can be pressed and both sections can be pulled out to the side together. This makes it very easy to change the bending head.

While several embodiments of the present invention have been shown and described, it is to be understood that many changes and modifications may be made thereunto without departing from the spirit and scope of the invention as defined in the appended claims.

What is claimed is:

1. Apparatus for forming and for bending rod-shaped components and sections of pipe comprising clamping units that are rotatable and are positioned to move longitudinally along a length of the apparatus and to move transversely along a width of the apparatus;

at least two bending units that are located in separate processing stations on different sides of the clamping units and said bending units are rotatable;

wherein each clamping unit has two clamping jaws and each of said clamping jaws is pivoted on one side; and wherein an adjustment unit engages each of said two clamping jaws and adjusts the position of said clamping jaws in relation to each other.

2. Apparatus according to claim 1, wherein each of the two clamping jaws is provided with teeth positioned in the shape of a circular arc such that the teeth of the two clamping jaws mesh with each other.

3. Apparatus according to claim 1, wherein there are two adjustment units and the adjustment units engage each of the two clamping jaws in an area facing away from a pivot bearing; and each adjustment unit comprises an adjustment wedge connected to an adjustment cylinder.

4. Apparatus according to claim 3, further comprising an additional bearing that is pivoted; and wherein the adjustment wedge is given support by said additional pivoted bearing.

5. Apparatus according to claim 1, wherein each clamping jaw has a clamping insert and each clamping insert is provided with an opening comprising a circular segment such that both circular segments together are shaped to match an external diameter of the components for forming and bending; and means for supporting the clamping inserts in the clamping jaws so that said clamping inserts are changeable.

6. Apparatus according to claim 1, further comprising means for pivoting the clamping unit around a horizontal axis of rotation to permit swivel movement of said clamping unit.

7. Apparatus according to claim 6, wherein the clamping unit has an at least approximately circular housing having a central point;

said housing having a radially located opening having two ends;

said opening projecting beyond the central point at one end of the opening and said opening being open towards outside at an other end of the opening.

8. Apparatus according to claim 7, further comprising a drive belt which engages an external circumference of the clamping unit and said drive belt surrounding 65% to 90% of the clamping unit.

9. Apparatus according to claim 8, wherein said drive belt has two ends; and said two ends of the drive belt are attached to an edge of the opening.

10. Apparatus according to claim 1, further comprising a bending unit which comprises two parts, with one part being an essentially cylindrical bottom section and the other part being a top section that matches the bottom section; and a semi-circular first groove that has the same diameter as the diameter of the component which is to be bent and that is open towards the outside of the bending unit and being incorporated in both of said top and bottom sections at the point where the bottom section and the top section meet.

11. Apparatus according to claim 10, wherein the semi-circular groove extends around at least 180° of a circumference of the bending unit.

12. Apparatus according to claim 10, further comprising a second groove section that is enclosed, extends tangentially to the bending unit and is open at two external ends;

said second groove section being adjacent to the first groove that is open towards the outside of the bending unit.

13. Apparatus according to claim 10, wherein the top section has means to permit axial movement in relation to the bottom section.

14. Apparatus according to claim 13, wherein the bottom section has means to permit axial movement.

15. Apparatus according to claim 10, further comprising a guide unit for securing the component in position in a radial direction located directly before the bending unit as seen from the direction of the clamping unit; and said guide unit having an open cross-section which is slightly larger than an external cross-section of the component;

whereby the guide unit can be opened so that the component can be loaded from the side.

16. Apparatus according to claim 10, further comprising means for supporting the bottom section and the top section in the bending unit in such a way that they can be taken out.

* * * * *